US005735359A

United States Patent [19]

Lee et al.

[11] Patent Number: 5,735,359

[45] Date of Patent: Apr. 7, 1998

[54] WELLBORE CUTTING TOOL

[75] Inventors: Mark H. Lee, Spring, Tex.; Robert S. Beeman, Bossier City, La.

[73] Assignee: Weatherford/Lamb, Inc., Houston, Tex.

[21] Appl. No.: 660,813

[22] Filed: Jun. 10, 1996

[51] Int. Cl.[6] ..... E21B 10/26

[52] U.S. Cl. ..... 175/269; 175/291

[58] Field of Search ..... 175/265, 266, 175/267, 269, 291, 292

[56] References Cited

U.S. PATENT DOCUMENTS

| | | | |
|---|---|---|---|
| 471,153 | 3/1892 | Swanson et al. . | |
| 833,240 | 10/1906 | Potter . | |
| 887,952 | 5/1908 | Milligan . | |
| 980,331 | 1/1911 | Peterson . | |
| 1,045,670 | 11/1912 | Buck et al. . | |
| 1,548,578 | 8/1925 | Blanchard . | |
| 1,583,073 | 5/1926 | Lawson . | |
| 1,667,190 | 4/1928 | Campbell | 175/283 |
| 1,710,580 | 4/1929 | LeBus . | |
| 1,720,950 | 7/1929 | Edwards | 175/277 |
| 1,881,035 | 10/1932 | Triplett . | |
| 2,215,632 | 9/1940 | Brack et al. | 166/298 |
| 2,284,170 | 5/1942 | Santiago | 175/269 |
| 2,586,878 | 2/1952 | Staton . | |
| 2,665,887 | 1/1954 | Shelton . | |
| 2,667,926 | 2/1954 | Alexander . | |
| 2,764,388 | 9/1956 | Camp . | |
| 2,822,150 | 2/1958 | Muse et al. | 175/266 |
| 2,859,943 | 11/1958 | Chadderdon | 175/269 X |
| 2,887,161 | 5/1959 | LeBus, Sr. . | |
| 2,994,389 | 8/1961 | LeBus, Sr. . | |
| 3,005,493 | 10/1961 | Crowe et al. | 166/55 |
| 3,056,453 | 10/1962 | Foreman, Jr. . | |
| 3,083,765 | 4/1963 | Kammerer | 166/298 |
| 3,386,521 | 6/1968 | Chadderdon et al. | 175/269 |
| 3,750,771 | 8/1973 | Cugini | 175/269 |
| 3,949,820 | 4/1976 | Furse | 175/286 |
| 4,068,711 | 1/1978 | Aulenbacher | 166/298 |
| 4,119,151 | 10/1978 | Smith | 166/298 |
| 4,191,255 | 3/1980 | Rives | 166/297 |
| 4,458,761 | 7/1984 | VanVreeswyk | 166/289 |
| 4,461,361 | 7/1984 | Fuchs | 175/269 |
| 4,589,504 | 5/1986 | Simpson | 175/269 X |
| 4,610,309 | 9/1986 | O'Brien et al. | 166/382 |
| 4,614,242 | 9/1986 | Rives | 175/269 |
| 4,618,009 | 10/1986 | Carter et al. | 175/267 |
| 4,796,709 | 1/1989 | Lynde et al. | 166/55.6 |
| 4,887,668 | 12/1989 | Lynde et al. | 166/55.8 |
| 4,889,197 | 12/1989 | Boe | 175/267 |
| 4,938,291 | 7/1990 | Lynde et al. | 166/55.8 |
| 4,978,260 | 12/1990 | Lynde et al. | 166/55.6 |
| 4,984,488 | 1/1991 | Lunde et al. | 166/55.6 |
| 5,010,955 | 4/1991 | Springer | 166/298 |
| 5,014,778 | 5/1991 | Lynde et al. | 166/55.6 |
| 5,018,580 | 5/1991 | Skipper | 175/269 X |
| 5,036,921 | 8/1991 | Pittard et al. | 166/298 |
| 5,038,859 | 8/1991 | Lynde et al. | 166/55.6 |
| 5,058,666 | 10/1991 | Lynde et al. | 166/55.6 |
| 5,060,738 | 10/1991 | Pittard et al. | 175/267 |
| 5,074,355 | 12/1991 | Lennon | 175/266 X |
| 5,086,838 | 2/1992 | Cassel et al. | 166/55.6 |
| 5,150,755 | 9/1992 | Cassel et al. | 166/297 |

(List continued on next page.)

OTHER PUBLICATIONS

"General Catalog 1974 – 1975" A–Z Int'l, 1974, pp. 163, 164, 170, 172, 174, 185, 186, 188, 190, 200.

*Primary Examiner*—William P. Neuder
*Attorney, Agent, or Firm*—Guy McClung

[57] ABSTRACT

A cutting tool has been invented for use in a wellbore to cut formation through which the wellbore extends or to cut items in the wellbore, the tool having, in one aspect, a body disposable at a desired location in the wellbore, at least one first blade pivotably mounted to the body at a first height on the body, at least one second blade pivotably mounted to the body at a second height on the body, the second height above the first height, the blades movable from a first position against the body to a second position extending out from the body for cutting, and the first blades shorter in length than the second blades.

19 Claims, 3 Drawing Sheets

U.S. PATENT DOCUMENTS 5,199,513 4/1993 Stewart et al. ..... 175/73
5,297,630 3/1994 Lynde et al. ..... 166/297
5,318,115 6/1994 Rouse ..... 166/55.7
5,351,758 10/1994 Henderson et al. ..... 166/277
5,373,900 12/1994 Lynde et al. ..... 166/297
5,456,312 10/1995 Lynde et al. ..... 166/55.6
5,495,899 3/1996 Pastusek et al. ..... 175/57
5,497,842 3/1996 Pastusek et al. ..... 175/334

21
23
20
32
34
31
22
24
25
35
30
40
43
10
33
42
45
51
131
132
38
41
44
151
152
133
50
52
54
53
39
134
55
87
86
80
135
58
66
1B
1B
67
137
60
136
59
76
77
1C
1C
70
138
149
36
37
158
157

20
30
40
10
50
134
80
2D
2B
2B
135
65
60
2D
137
2C
2C
159
136
70
138

WELLBORE CUTTING TOOL

BACKGROUND OF THE INVENTION

1. Field of the Invention

This invention is directed to wellbore cutting tools, and in certain particular aspects, to drilling, reaming and milling tools; and, in one particular aspect, to an underreamer for enlarging an uncased borehole or a borehole cased with one or more tubulars.

2. Description of Related Art

Earth boring operations for drilling oil and gas wells use drill strings that proceed to great depths. Typically a drilling "mud" is pumped down the drill string for cooling the drill bit. Often there is a need to "underream" the hole, to enlarge its diameter at some point below the surface. A variety of underreamers and hole openers have been developed. With such tools the fluid pressure of the drilling mud can be employed for actuation. Often the drill string is withdrawn from the hole and a suitable underreamer is installed either alone or in series with a conventional pilot drill. After the drill string has been tripped back into the hole, pressure of drilling fluid is applied and through any of a variety of mechanisms cutter arms on the underreamer are urged outwardly for enlarging the selected portion of the hole. Then the cutter arms are retracted and the underreamer is withdrawn from the hole. In certain aspects such underreamer arms are extended whenever drilling fluid pressure is applied, i.e. at all time when drilling is being conducted.

Certain prior art underreaming tools have a body structure formed of inner and outer body sections with cutter arms pivotally secured on the outer body section and a piston and cylinder means defined between the inner outer body sections to receive hydraulic fluid to effect telescopic movement of the body sections in one relative direction so a cam surface mechanically engages and forces the cutter arms out to underreaming or bore hole enlarging position.

When the underreaming operation is completed, the cutter arms of these prior art devices are retracted by raising the operating string on which the body structure is supported so that the expanded or projecting arms engage the shoulder formed at the huncture of the upper end of the enlarged underreamed portion with the smaller bore. Continued raising of the operating string exerts a force on the extended cutter arms to endeavor to force the arms inwardly to retracted position relative to the body structure.

When obstructions or mud prevents relative longitudinal telescopic movement between the inner and outer body sections so that the cutter arms can retract, then it has been generally customary to continue exerting a pull on the operating string until some portion of the bore hole enlarging structure breaks so that it then may be withdrawn from the well bore. If the structure of the prior art tools malfunctions or breaks so that the inner and outer bodies are locked against telescopic movement while the arms are in extended position, then the arms again are forced to collapsed position by pulling up on the operating string to try to force them to retracted position, or to break wheatever structure may be necessary to enable the tool to be withdrawn from the bore hole.

When the arms of the bore hole enlarger are extended during drilling operations to underream or drill an enlarged portion in a bore hole, there are various forces that act upon them. These forces sincluded an upwardly directed force on the outer projecting end of the arm due to the reaction from the weight of the operating string during drilling operations, a force which tends to move the cutter arms back towards retracted position due to the angle of the hole, a force due to the reaction from rotation while drilling the formation which tends to retract the cutter arms inwardly, and a force which arises from rotation during bore hole enlarging operations so that formation pressure against the leading edge of the arm along its axial extent tends to flex the cutter arm.

These forces are transmitted from the cutter arms to the pivot arrangement of the cutter arms on the body structure and cam surface relied upon to move and maintain the cutter arms in extended cutting position. In some circumstances these forces may be substantial and in some instances damage or break components of the tool.

In certain prior art tools expandable arms are moved outwardly by means of a pressure actuated piston mounted within the main bore of a tool housing. The ends of the expandable arms may be provided with a machined surface, cutting material, or cutting inserts for engaging certain types of formations and cutting a larger hole than created by the drill bit. There are several patents which disclose various underreaming tools.

Muse et al, U.S. Pat. No. 2,822,150, discloses a rotary expansible drill bit having upper and lower cutters pivotally mounted on a main body and connected by a rack and pinion mechanism to a plunger for simultaneously expanding the cutters outwardly from the main body.

Hailey, U.S. Pat. No. 4,809,793, discloses a downhole cutting tool which includes longitudinal bores which are opened to fluid flow when the cutting members are moved to their extended positions. The tool has upper and lower subassemblies connected together through an adapter which establishes an angular offset between an upper and lower pair of extendable cutter members. However, in both the upper and lower subassemblies, one passage is continuously open to fluid flow at all times and the other passage is initially closed and only opens on predetermined movement of the piston or pistons which open the extendable cutters. The present invention has a different sequence of operation resulting from a different internal construction. In the present invention, the flow passages in both the upper and lower body portions are not open to flow until the upper piston has first moved to open the upper flow passages.

Baker, U.S. Pat. Nos. 2,548,931 and 2,644,673, and Huitt et al, U.S. Pat. No. 3,050,122, disclose underreamers having cutter blades pivotally mounted on a main body and connected by link members to a plunger for simultaneously expanding the cutters outwardly from the main body.

Emanuel et al, U.S. Pat. No. 2,756,968, discloses an expansible well scraper having scraper blades pivotally mounted on a main body and connected by a toothed mechanism to a plunger for simultaneously expanding the cutters outwardly from the main body.

Campbell et al, U.S. Pat. No. 4,565,252, discloses an underreamer or milling tool having simultaneously expansible arms pivotally mounted on a main body. A rotary fluid housing is mounted within each arm and includes a body nozzle for receiving fluid from the body and an expandable arm nozzle for directing fluid into a bore which extends through the arm to provide circulating fluid outwardly of the expandable arm.

Pastusek et al, U.S. Pat. No. 5,497,842, discloses a reaming apparatus for enlarging a borehole which has a tubular body with primary blade(s) and secondary blade(s) which extend a lesser radial distance from the body than the primary blade(s).

Pastusek et al, U.S. Pat. No. 5,495,899 discloses a multi-bladed reaming apparatus with blades unequally spaced around a tool body.

Problems associated with thru-tubing underreaming include the failure to underream out to a sufficiently large diameter and the inability to handle relatively large torques.

There has long been a need for an efficient and effective milling tool. There has long been a need for an efficient and effective underreamer. There has long been a need for such tools whose arms can withstand relatively high torque. There has long been a need for such tools which can be used effectively "thru-tubing" to work in a larger diameter tubular disposed below a smaller diameter tubular.

SUMMARY OF THE PRESENT INVENTION

The present invention, in certain aspects, discloses a tool useful as a milling tool or an underreaming tool. In one aspect the tool has an outer body within which is movably disposed a mandrel. The mandrel is connected at the top to an item in a tubular or drill string, e.g. threadedly connected to a top sub having a flow channel therethrough from top to bottom which is in fluid communication with a flow channel through the mandrel which extends from the top to the bottom of the mandrel.

A spring between and biased against the mandrel and the outer body initially urges the outer body downwardly with respect to the mandrel; and a plurality of cutter arms pivotably connected to the outer body are initially positioned against the body in a nonextended fashion.

An open orifice at the lower end of the mandrel restricts fluid flow out from the mandrel. An increase of fluid flow above a certain amount increases pressure within the mandrel. When this pressure reaches a certain desired level, e.g. about 50 p.s.i., pressure build-up in a pressure chamber of the mandrel in fluid communication with the mandrel's central flow bore compresses the spring. This results in the outer body moving upwardly. This upward movement brings "kick-out" surfaces of the mandrel into contact with the pivotable cutter arms causing them to pivot to an extended cutting positon.

In one aspect one or more of the cutter arms (lower, upper, or all) has a support which is also pivotably connected to the mandrel and which moves out to releasably engage and support the cutter arm. In certain embodiments a washout port is provided through the mandrel, in fluid communication with the central flow bore of the mandrel, which is sized, configured, and disposed so that a portion of the fluid flow in through the central flow bore exits through the washout port to clean the blades. Such a port may be provided for each blade.

In certain embodiments one or more (two, three, four, or more) first blades of a first length are provided at a first level of the tool. In one aspect the first blade(s) are provided near a lower end of the tool. One or more (two, three, four or more) second blades are provided at a second level of the tool, above the first level, and the second blade(s) are longer than the first blade(s). In this way the "bite" which the second blade(s) take out of the tubulars and/or formation to be milled or underreamed is reduced and more efficient operation is achieved.

One particular tool according to the present invention initially has an outside diameter of about 1.70 inches; three first blades spaced apart 120 degrees around the tool's circumference, each first blade about 2 inches long (i.e. from pivot pin center to blade end); and three second blades spaced apart 120 degrees around the tool's circumference, each second blade about 5 inches long. In this tool the first blades are about 6.75 inches up from a shoulder on the lower end of the mandrel, about 6.0 inches up from the shoulder; the second blades are about 4.75 inches up from the shoulder; and about 4.0 inches up from the shoulder. The blades are offset at the different levels; i.e., in a top view a blade appears every 60 degrees with first and second blades alternating. (Although it is within the scope of this invention for the first and second blades to be lined up, as viewed from above, or spaced apart any desired amount.)

The cutting surfaces of the blades, including bottom, side, and top surfaces may be dressed with any known matrix, diamond or carbide material (e.g. Klustrite, Zitco, Kutrite), or diamond dressing; any known cutting insert or plurality of inserts in any known pattern or array applied to the blades in any known manner; or any combination thereof (all collective referred to as "cutting material").

The inner mandrel in one aspect has kick-out surfaces disposed so that only one set of blades is initially extended and then, with increased fluid pressure and resulting additional outer body movement, the second set of blades is extended. Accordingly, in a tool with three or more blade sets, each set can be either simultaneously or sequentially extended.

Once the blades are extended, cutting, milling and/or underreaming is initiated by rotating a drill string to which the tool is connected or by activating a downhole motor to which the tool is connected. Any known system or apparatus for orienting a downhole tool and for indicating position of a downhole tool may be used with a tool according to the present invention.

In certain embodiments with two or more sets of blades at different heights on the tool all the blades are the same length and extend outwardly from the tool the same distance. In other embodiments blades in a higher set are longer than blades in a lower set. In one embodiment, some blades in a higher set are the same length as blades in a lower set and some of the blades are longer than blades in a lower set; in one aspect blades in a higher set the same length as blades in a lower set alternate with blades of longer length, e.g. around the tool's circumference at the higher level a shorter blade is between two longer blades, etc., e.g. in one particular aspect one blade is about 0.1 inches shorter than an adjacent blade.

In certain embodiments, the present invention discloses a mill, underreamer, and a cutting tool for use in a wellbore, the tool having an inner mandrel connectible to a tubular string extending from a surface of the wellbore down to a subterranean location in the wellbore, an outer body disposed about the inner mandrel and movable with respect thereto, at least one first blade pivotably mounted to the outer body at a first height on the outer body, at least one second blade pivotably mounted to the outer body at a second height on the outer body, the second height above the first height, and the blades movable from a first position against the outer body to a second position extending out from the outer body when the outer body moves upwardly with respect to the inner mandrel; such a tool wherein the at least one first blade is a plurality of first blades spaced apart around the outer body; such a tool wherein the at least one second blade is a plurality of second blades spaced apart around the outer body; such a tool wherein the at least one second blade is longer than the at least one first blade; such a tool wherein the at least one second blade is a plurality of second blades spaced apart around the outer body and the first blades are offset from the second blades as viewed from above; such a tool wherein the at least one first blade and the at least one second blade are dressed with cutting material; such a tool wherein the at least one second blade has a support notch and the tool has a a support arm corresponding to each of the at least one second blade, the support arm pivotably connected to the outer body and movable outwardly by contacting the inner mandrel as the outer body moves upwardly with respect to the inner mandrel, and the support arm movable so that a portion thereof moves into the support notch of the at least one second blade and is releasably held therein; such a tool wherein a spring disposed between the inner mandrel and the outer body initially urges them apart and wherein the inner mandrel has a mandrel bore flow extending flow extending therethrough and a fluid exhaust port for exhausting fluid from the mandrel bore into a pressure chamber defined by a portion of an exterior surface of the inner mandrel and the outer body, the pressure chamber for receiving fluid under pressure pumped down the inner mandrel and for holding sufficient fluid to overcome the spring force of the spring to activate the cutting tool by urging the outer body upwardly with respect to the inner mandrel thereby moving the at least one first blade and the at least one second blade upwardly and outwardly from the outer body; such a tool wherein the inner mandrel has a flow restriction to facilitate a desired build up of fluid pressure in the pressure chamber; such a tool with a fluid flow bore through the inner mandrel from a top end thereof to a bottom end thereof, a first fluid washout port adjacent the at least one first blade and a second fluid washout port adjacent the at least one second blade, and the fluid washout ports in fluid communication with the fluid flow bore and disposed for jetting fluid toward the blades; such a tool with the inner mandrel movable upwardly by pulling thereon after the blades have been extended so that the blades retract against the outer body; such a tool wherein the first blades have first blade contact surfaces and the inner mandrel has a first kick-out surface adjacent each first blade so that as the outer body moves upwardly with respect to the inner mandrel each first blade contacts a respective first kick-out surface and is thereby moved outwardly from the outer body; such a tool wherein the second blades have second blade contact surfaces and the inner mandrel has a second kick-out surface adjacent each second blade so that as the outer body moves upwardly with respect to the inner mandrel each second blade contacts a respective second kick-out surface and is thereby moved outwardly from the outer body; such a tool with the outer body having a compartment for each blade and from which each blade is outwardly and upwardly pivotable, each blade initially positionable in a respective compartment so that the blade does not project beyond an outer surface of the outer body prior to outward extension of the blades; such a tool with the inner mandrel having an indented portion adjacent each blade for receiving a portion of each blade prior to blade extension; such a tool with a downhole motor connected to the cutting tool; such a tool with a measurement-while-drilling system connected to the cutting tool; such a tool with a mill connected to a lower end of the cutting tool; and such a tool with a drill bit connected to a lower end of the cutting tool.

It is, therefore, an object of this invention to provide:

New, useful, unique, efficient, nonobvious tool for cutting, milling, reaming, and/or underreaming in a wellbore;

Such a tool with multiple blade sets positioned at different heights on the tool;

Such a tool with blade sets which extend out from the tool to different lengths radially;

Such a tool with blades supported by blade supports; and

Such a tool in which different sets of blades are offset from each other circumferentially around the tool.

Certain embodiments of this invention are not limited to any particular individual feature disclosed here, but include combinations of them distinguished from the prior art in their structures and functions. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings, disclosures, and suggestions, other purposes and advantages will be appreciated from the following description of preferred embodiments, given for the purpose of disclosure, when taken in conjunction with the accompanying drawings. The detail in these descriptions is not intended to thwart this patent's object to claim this invention no matter how others may later disguise it by variations in form or additions of further improvements.

DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or legally equivalent embodiments.

DESCRIPTION OF EMBODIMENTS PREFERRED AT THE TIME OF FILING FOR THIS PATENT

Figure 1A:
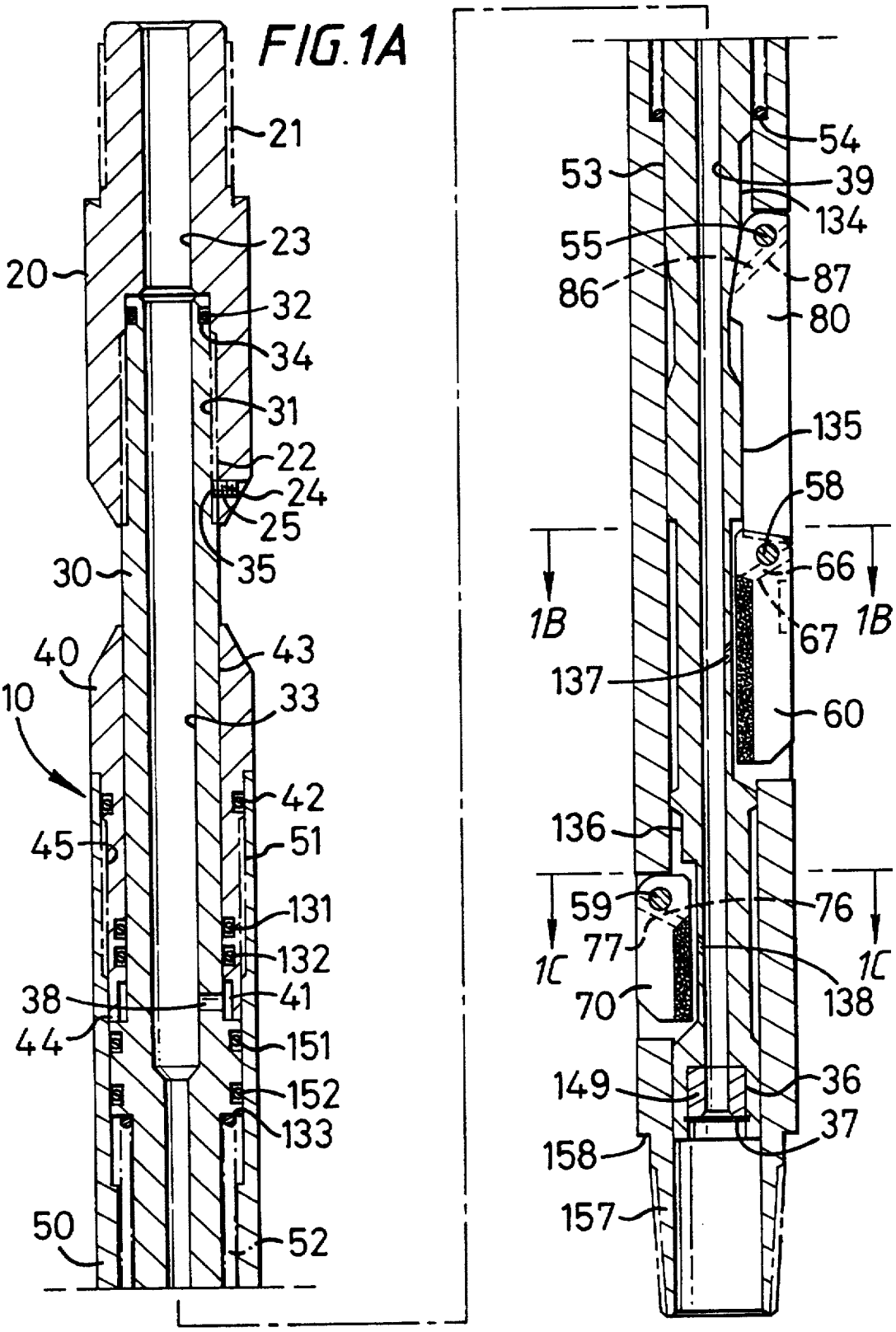
FIG. 1A is a side cross-sectional view of a tool according to the present invention.
Figure 1B:
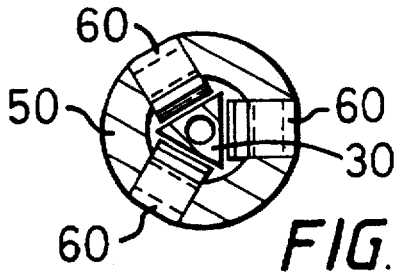
FIG. 1B is a cross-sectional view along line 1B—1B of FIG. 1A.
Figure 1C:
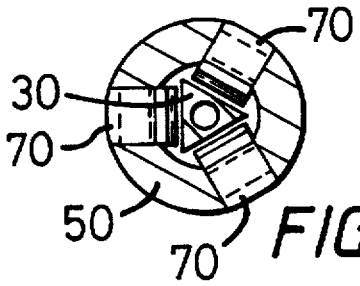
FIG. 1C is a cross-sectional view along line 1C—1C of FIG. 1A.

Referring now to FIG. 1, a tool 10 according to the present invention has a top sub 20 threadedly connected to a mandrel 30 about which is movably disposed a connector 40 to which is threadedly connected an outer body 50. A first set of one or more first blades 60 are pivotably connected to the outer body 50 at a first height or level on the outer body 50 and a second set of one or more second blades 70 are pivotably connected to the outer body 50 at a second height or level on the outer body 50 lower than the first height or level of the first blades 60. The second blades 70 are shorter in length than the first blades 60. Blade supports 80 support the first blades 60 when they are extended.

The top sub 20 is connectible to any typical member of a tubular string or drill string, including, but not limited to, a mud motor, a measurement-while-drilling system, or a shock sub. The top sub 20 has an upper externally threaded end 21 and a lower internally threaded end 22. A flow bore 23 extends from one end of the top sub to the other. A locking screw 24 in a bore 25 extends into a groove 35 of the mandrel 30 to prevent the top sub 20 from separating from the mandrel 30.

The mandrel 30 has a top externally threaded end 31 with an O-ring 32 in a recess 34 to seal the mandrel/top sub interface. A flow restrictor or choke 149 is secured in a recess 36 and is held in place by a snap-ring 37. An O-ring may be used between the choke and the surface of the mandrel. The choke may be any size to restrict the flow out from the mandrel any desired amount. As shown the choke has a central flow bore the same diameter as the bore through the mandrel; but the bore through the choke may be smaller in diameter than the bore through the mandrel. A fluid flow port 38 permits fluid flowing through upper flow bore 33 to flow from within the mandrel 30 into a chamber 41 formed by the mandrel 30 and the connector 40. A lower flow bore 39 is of a lesser diameter than that of the upper flow bore 33. O-rings 131, 132 seal the mandrel/outer body interface. A shoulder 133 provides a surface against which a spring is biased. A kick-out surface 134 is positioned adjacent each blade supports 80; a kick-out surface 135 is positioned adjacent each blade 60; and a kick-out surface 136 is positioned adjacent each blade 70. A washout port 137 for fluid flow to the blades is positioned adjacent each blade 60; and a washout port 138 for fluid flow to the blades is positioned adjacent each blade 70.

The connector 40 has a lower threaded end 41 threadedly connected to the outer body 50. An O-ring 42 seals the connector/outer body interface. A descending lip 44 defines part of the chamber 41. A central bore 43 extends through the connector 40 from one end to the other.

The outer body 50 has an upper threaded end 51 which is threadedly connected to the lower threaded end 41 of the connector 40. O-rings 151, 152 seal the mandrel/outer body interface. A spring 52 is biased against the shoulder 133 of the mandrel 30 and against a shoulder 54 of the outer body 50. Initially this spring urges the outer body 50 downwardly with respect to the mandrel 30 and maintains these parts in the position shown in FIG. 1A.

Each blade support 80 is pivotably mounted to the outer body 50 with a pivot pin 55. A holding pin 86 in a channel 87 holds the pivot pin 55. Each blade 60 is pivotably mounted to the outer body 50 with a pivot pin 58. A holding pin 66 in a channel 67 holds the pivot pin 58. Each blade 70 is pivotably mounted to the outer body 50 with a pivot pin 59. A holding pin 76 in a channel 77 holds the pivot pin 59.

A bore 53 extends through the outer body 50 from one end to the other. A lower end 157 of the outer body 50 with a shoulder 158 is connectible to any typical member of a drill string, tubular string, or string with a downhole motor or mud motor.

Figure 2B:
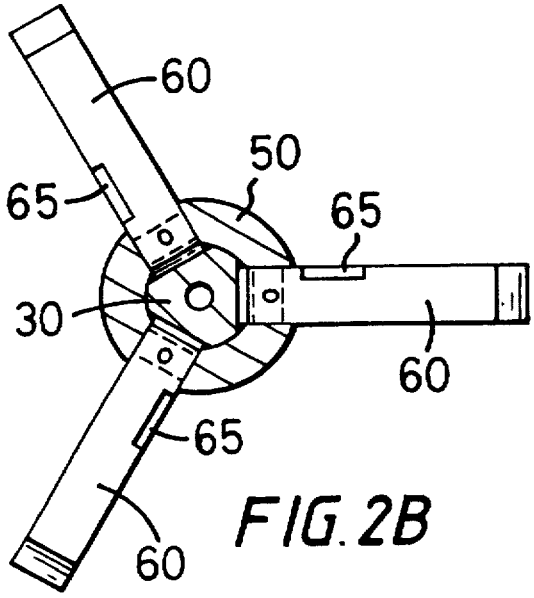
FIG. 2B is a cross-sectional view along line 2B—2B of FIG. 1A.
Figure 2C:
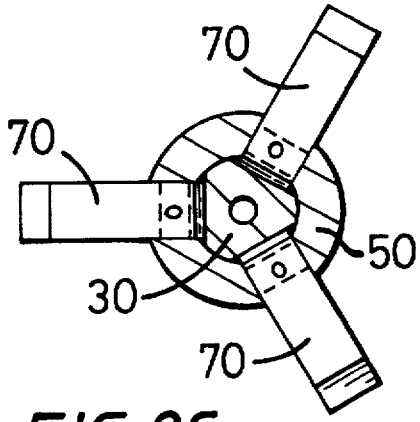
FIG. 2C is a cross-sectional view along line 2C—2C of FIG. 1A.
Figure 2E:
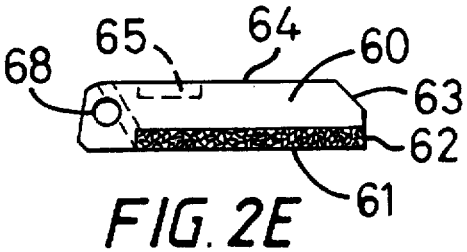
FIG. 2E is a side view of a blade of the tool of FIG. 2A.
Figure 2F:
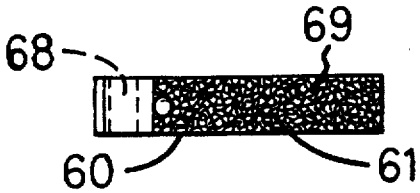
FIG. 2F is a bottom view of the blade of FIG. 2E.
Figure 2D:
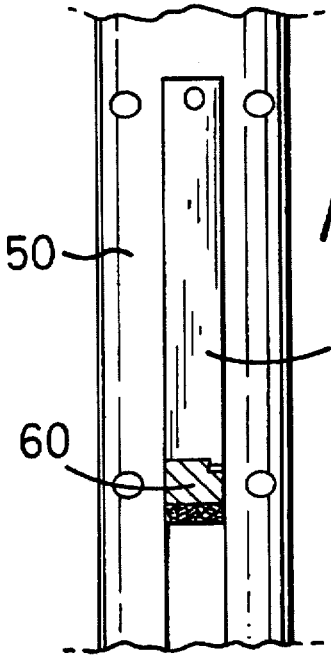
FIG. 2D is a cross-sectional view along line 2D—2D of FIG. 1A.

Each blade 60 (see FIGS. 1A, 2E and 2F) has a lower surface 61, a side surface 62, a side surface 63, a top surface 64, a torque notch 65 and a pivot pin hole 68. As shown the blades 60 have a crushed carbide cutting matrix 69 on the lower surface 61 and part of the side surface 62. It is within the scope of this invention for the entire blade to be covered with such a matrix. It is also within the scope of this invention to use cutting inserts on, one, some or all of the surfaces in any known disposition, pattern or array for such inserts as known for drilling, milling, or reaming tools, with or without one or more chipbreakers on each insert.

Figure 2A:
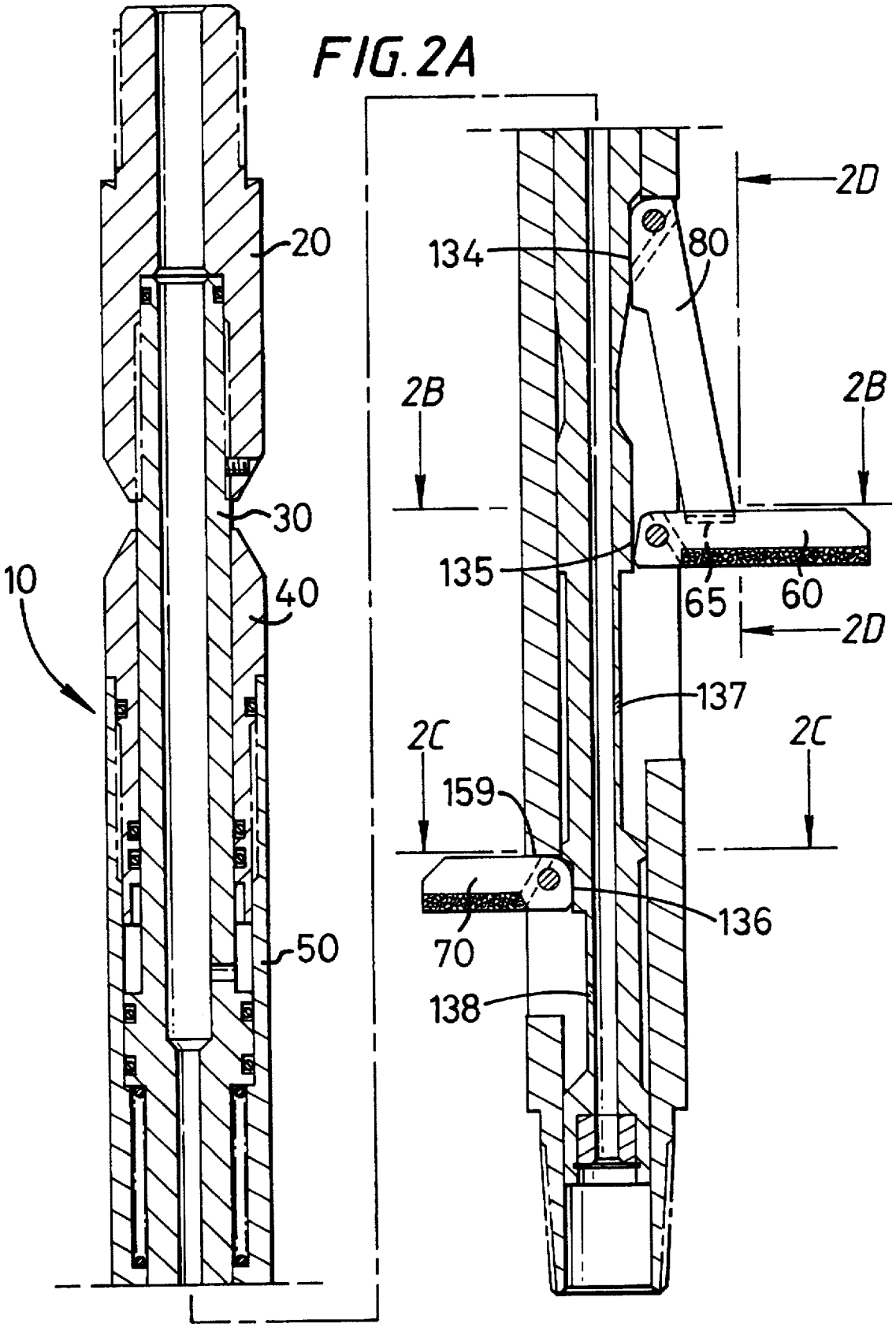
FIG. 2A is a side cross-sectional view of the tool of FIG. 1A.

As shown in FIG. 2A fluid under pressure (e.g. drilling fluid, mud, water, etc.) flowing through the tool 10 has increased pressure within the chamber 41 to such a level that the force of the spring 52 has been overcome and the connector 40 and outer body 50 have moved upwardly with respect to the mandrel 30. This movement has brought an end of each blade support 80 into contact with its respective kick-out surface 134, forcing each blade support 80 outwardly.

Upward movement of the outer body 50 has also brought an end of each blade 60 into contact with its respective kick-out surface 135, forcing each blade 60 outwardly. An end 85 of each blade support 80 has moved into a torque notch 65 of its respective blade 60 to stop extension of each blade 60 any further and to support each blade 60 during cutting.

Upward movement of the outer body 50 has also brought an end of each blade 70 into contact with its respective kick-out surface 136, forcing each blade 70 outwardly. The outward movement of each blade 70 ceases when it abuts a stop surface 159 of the outer body 50.

As shown in FIG. 2A each blade 60 is positioned so that fluid flowing through the washout ports 137 flushes material away from the blades 60. Each blade 70 is positioned so that fluid flowing through the washout ports 138 flushes material away from the blades 70. As viewed from above or below (e.g. in FIGS. 2B and 2C) the first blades are 60 degrees offset from the second blades.

By reducing the fluid pressure through the tool, the spring force urges the outer body downwardly and the blades are retracted. Alternatively, pulling upwardly on the top sub 20 and mandrel 30, the blade supports 80 and blades 60, 70 are moved off their respective kick-out surfaces and back into the outer body 50.

In one typical operation of the tool 10, the tool's upper end is connected to a mud motor and the tool's lower end is connected to a mill or bit. The tool is passed through a tubing string with a relatively small inner diameter and into a casing of larger diameter. The blades are extended and reaming commences. Upon completion of the reaming operation, the blades are retracted and the tool is removed from the wellbore.

In certain "thru-tubing" applications, the tool 10 is sized so that initially, it can be inserted through tubing, e.g. in one particular aspect tubing with an inside diameter of 1.995 inches.

In conclusion, therefore, it is seen that the present invention and the embodiments disclosed herein and those covered by the appended claims are well adapted to carry out the objectives and obtain the ends set forth. Certain changes can be made in the subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form it may be utilized. The invention claimed herein is new and novel in accordance with 35 U.S.C. § 102 and satisfies the conditions for patentability in § 102. The invention claimed herein is not obvious in accordance with 35 U.S.C. § 103 and satisfies the conditions for patentability in § 103. This specification and the claims that follow are in accordance with all of the requirements of 35 U.S.C. § 112.

What is claimed is:

1. A cutting tool for use in a wellbore, the tool comprising an inner mandrel connectible to a tubular string extending from a surface of the wellbore down to a subterranean location in the wellbore, an outer body disposed about the inner mandrel and movable with respect thereto, at least one first blade pivotably mounted to the outer body at a first height on the outer body, at least one second blade pivotably mounted to the outer body at a second height on the outer body, the second height above the first height, and the at least one second blade having a support notch, the at least one first blade and the at least one second blade movable from a first position against the outer body to a second position extending out from the outer body when the outer body moves upwardly with respect to the inner mandrel a support arm corresponding to each of the at least one second blade, the support arm pivotably connected to the outer body and movable outwardly by contacting the inner mandrel as the outer body moves upwardly with respect to the inner mandrel, and the support arm movable so that a portion thereof moves into the support notch of the at least one second blade and is releasably held therein.

2. The cutting tool of claim 1 wherein the at least one first blade is a plurality of first blades spaced apart around the outer body.

3. The cutting tool of claim 1 wherein the at least one second blade is a plurality of second blades spaced apart around the outer body.

4. The cutting tool of claim 1 wherein the at least one second blade is longer than the at least one first blade.

5. The cutting tool of claim 2 wherein the at least one second blade is a plurality of second blades spaced apart around the outer body and the first blades are offset from the second blades as viewed from above.

6. The cutting tool of claim 1 wherein the at least one first blade and the at least one second blade are dressed with cutting material.

7. The cutting tool of claim 1 wherein a spring disposed between the inner mandrel and the outer body initially urges them apart and wherein the inner mandrel has a mandrel bore for fluid flow extending therethrough and a fluid exhaust port for exhausting fluid from the mandrel bore into a pressure chamber defined by a portion of an exterior surface of the inner mandrel and the outer body, the pressure chamber for receiving fluid under pressure pumped down the inner mandrel and for holding sufficient fluid to overcome the spring force of the spring to activate the cutting tool by urging the outer body upwardly with respect to the inner mandrel thereby moving the at least one first blade and the at least one second blade upwardly and outwardly from the outer body.

8. The cutting tool of claim 7 wherein the inner mandrel has a flow restriction to facilitate a desired build up of fluid pressure in the pressure chamber.

9. The cutting tool of claim 1 further comprising a fluid flow bore through the inner mandrel from a top end thereof to a bottom end thereof, a first fluid washout port adjacent the a least one first blade and a second fluid washout port adjacent the at least one second blade, and the fluid washout ports in fluid communication with the fluid flow bore and disposed for jetting fluid toward the blades.

10. The cutting tool of claim 1 further comprising the inner mandrel movable upwardly by pulling thereon after the blades have been extended so that the blades retract against the outer body.

11. The cutting tool of claim 1 wherein the first blades have first blade contact surfaces and the inner mandrel has a first kick-out surface adjacent each first blade so that as the outer body moves upwardly with respect to the inner mandrel each first blade contacts a respective first kick-out surface and is thereby moved outwardly from the outer body.

12. The cutting tool of claim 1 wherein the second blades have second blade contact surfaces and the inner mandrel has a second kick-out surface adjacent each second blade so that as the outer body moves upwardly with respect to the inner mandrel each second blade contacts a respective second kick-out surface and is thereby moved outwardly from the outer body.

13. The cutting tool of claim 1 further comprising the outer body having a compartment for each blade and from which each blade is outwardly and upwardly pivotable, each blade initially positionable in a respective compartment so that the blade does not project beyond an outer surface of the outer body prior to outward extension of the blades.

14. The cutting tool of claim 13 further comprising the inner mandrel having an indented portion adjacent each blade for receiving a portion of each blade prior to blade extension.

15. The cutting tool of claim 1 further comprising a downhole motor connected to the cutting tool.

16. The cutting tool of claim 1 further comprising a measurement-while-drilling system connected to the cutting tool.

17. The cutting tool of claim 1 further comprising a mill connected to a lower end of the cutting tool.

18. The cutting tool of claim 1 further comprising a drill bit connected to a lower end of the cutting tool.

19. A cutting tool for use in a wellbore, the tool comprising an inner mandrel connectible to a tubular string extending from a surface of the wellbore down to a subterranean location in the wellbore, an outer body disposed about the inner mandrel and movable with respect thereto, a plurality of first blades spaced apart around and pivotably mounted to the outer body at a first height on the outer body, a plurality of second blades spaced apart around and pivotably mounted to the outer body at a second height on the outer body, the second height being above the first height, each second blade having a top surface with a support notch therein, the blades movable from a first position against the outer body to a second position extending out from the outer body when the outer body moves upwardly with respect to the inner mandrel, the second blades being longer than the first blades, a support arm corresponding to each of the second blades, the support arm pivotably connected to the outer body and movable outwardly by contacting the inner mandrel as the outer body moves upwardly with respect to the inner mandrel, and the support arm movable so that a portion thereof moves into the support notch of a corresponding second blade and is releasably held therein, the inner mandrel movable upwardly after the blades have been extended to retract the blades against the outer body, and the blades each having blade contact surfaces and the inner mandrel having a kick-out surface adjacent each blade so that as the outer body moves upwardly with respect to the inner mandrel each blade contacts a respective kick-out surface and is thereby moved outwardly from the outer body.

* * * * *